340-552 SR

11/20/84 OR 4,484,182

United States Patent [19]

Schofield et al.

[11] Patent Number: 4,484,182

[45] Date of Patent: Nov. 20, 1984

[54] INTRUDER DETECTION APPARATUS FOR FUNCTIONING FREE OF DISTURBANCE WHILE IN CLOSE PROXIMITY TO HIGH-POWER PULSE-MOLDULATED RADARS

[75] Inventors: Roy A. Schofield; Edward Wilson, both of Darwen, England

[73] Assignee: Shorrock Developments Limited, Blackburn, England

[21] Appl. No.: 509,368

[22] Filed: Jun. 30, 1983

Related U.S. Application Data

[63] Continuation-in-part of Ser. No. 279,540, Jul. 1, 1981, abandoned.

[51] Int. Cl.[3] ..... G08B 13/24

[52] U.S. Cl. ..... 340/552; 340/501

[58] Field of Search ..... 340/552, 600, 572, 501, 340/554

[56] References Cited

U.S. PATENT DOCUMENTS

| | | | |
|---|---|---|---|
| 3,465,336 | 9/1969 | Fishbein et al. | 340/554 |
| 3,696,379 | 10/1972 | Minasy | 340/572 |
| 3,839,709 | 10/1974 | Sugiura | 340/552 |
| 3,943,503 | 3/1976 | Whitman | 340/552 |
| 4,010,459 | 3/1977 | Pontoppidan et al. | 340/552 |
| 4,117,466 | 9/1978 | Lichtblau | 340/572 |
| 4,322,722 | 3/1982 | Kozdon | 340/552 |

*Primary Examiner*—Glen R. Swann, III

*Attorney, Agent, or Firm*—Ross, Ross & Flavin

[57] ABSTRACT

In the receiver of an outdoor intruder detection apparatus, which receiver is spaced from and receives signals from a microwave transmitter and provides an alarm output upon the occurrence of change in the received signal, eliminator means is provided for eliminating pulses which may be superimposed on the signals from nearby radar. Such eliminator means comprises a wide band amplifier which serves, by way of a monostable to actuate a switch which gates out, in synchronism with the superimposed pulses, the detected signals from an aerial and diode as supplied by way of amplifiers and a delay line to further signal-processing circuitry.

1 Claim, 1 Drawing Figure

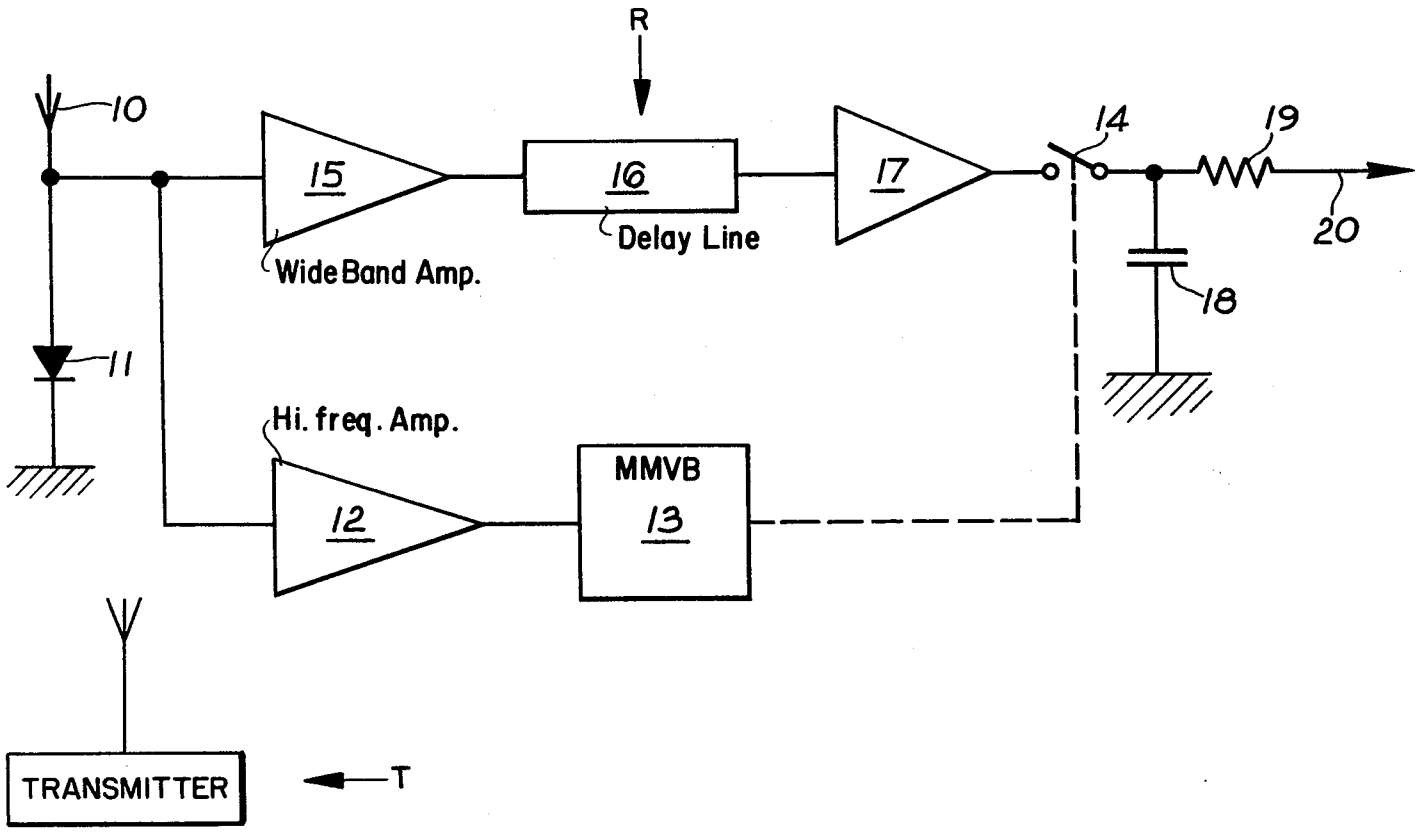
R
10
11
15
Wide Band Amp.
16
Delay Line
17
14
19
20
18
Hi. freq. Amp.
12
MMVB
13
T
TRANSMITTER

INTRUDER DETECTION APPARATUS FOR FUNCTIONING FREE OF DISTURBANCE WHILE IN CLOSE PROXIMITY TO HIGH-POWER PULSE-MOLDULATED RADARS

CROSS-REFERENCE TO A RELATED APPLICATION

This application is a continuation-in-part of application Ser. No. 279,540 filed July 1, 1981, now abandoned.

BACKGROUND OF THE INVENTION

This invention concerns intruder detection apparatus.

Various forms of intruder detection apparatus, particularly suitable for outdoor detection using a microwave transmitter and receiver combination, with the transmitter and receiver being spaced some distance apart and aligned with each other, are known. The receiver monitors the level of a signal received from the transmitter and, should there be a change in the level of the received signal, indicative of an intruder encroaching on the area between the transmitter and receiver, an alarm is produced. A typical detector of this kind, often known as a "microwave fence" is exemplified by United Kingdom Pat. No. 1409658.

However, on occasion, it is a requirement that such a microwave fence be required to function in close proximity to high-power pulse-modulated radars. Then, the received signal level at the microwave fence receiver, from its own transmitter, may be quite low, whereas the signal level, at the same receiver, resulting from the proximity of the radar, may be extremely high. Differences of the order of 120 db can be experienced. Further, the operating frequencies of the microwave fence and radar can be of the same order, so that not surprisingly the operation of the microwave fence can be disturbed as a result of breakthrough of the radar signal into the microwave fence receiver, causing malfunction.

Typically, the radar pulses are a few microseconds wide and have a pulse-repetition frequency of 1 $KH_z$.

An object of the present invention is to provide a microwave fence arrangement wherein the above-discussed difficulty is obviated.

BRIEF SUMMARY OF THE INVENTION

With this object in view, the invention provides intruder detection apparatus comprising a microwave transmitter, a corresponding receiver spaced from and aligned with the transmitter so as to receive and monitor a signal from the transmitter and provide an alarm output upon detection of a change in the monitored signal indicative of an intrusion into the area between the transmitter and receiver, characterized by the provision of eliminator means effective to eliminate any interfering pulses which may be superimposed upon the detected signal (e.g. by adjacent radar or other apparatus) comprising a selector means operative to gate out the input to the receiver in response to each interfering pulse, for a period exceeding the duration of the pulse, and a delay means effective to synchronize the respective gating-out condition with the pulse, thereby to prevent the pulse from being supplied to the receiver.

Thus what is involved here in an intruder detection system is a microwave fence consisting of a microwave transmitter modulated at a low frequency, typically 1 $KH_z$, and a receiver means spaced from the transmitter for receiving a detected signal from the transmitter and for additionally receiving in superimposed disposition an interfering signal in the form of narrow pulses from a nearby high power pulse modulated radar system and adapted for preserving the modulation waveform from the transmitter and removing the interfering pulses from the radar system and indicating by an alarm a change in the level of monitored signal indicative of the encroachment of an intruder in the area between the transmitter and receiver.

The invention comprehends a selector means for gating out the receiver input responsively to each interfering pulse for a period exceeding the pulse duration. Such selector means includes a primary high frequency wide band selective amplifier for passing the narrow band radar pulses while substantially rejecting the low frequency modulation, a flip-flop triggered by the output of the primary amplifier for generating a corresponding pulse of approximately 30 microseconds duration for each amplifier pulse, a normally-closed switch controlled by the flip-flop and openable for the duration of the flip-flop generated pulse for gating in synchronism with the superimposed pulse, a secondary wide band amplifier for additionally receiving the detected signal, a delay line for receiving and delaying the secondary amplifier output, a delay line amplifier for amplifying the delay line output before the feeding thereof to the normally-closed switch, the normally-closed switch in the event of radar interference being openable before the interfering pulse reaches the delay line amplifier output for suppressing the interfering pulse during the switch-open mode, a capacitor and resistor for feeding the microwave fence modulation free of the interfering pulse, and means for providing an alarm output upon the occurrence of a change in the monitored signal level.

BRIEF DESCRIPTION OF THE DRAWING

The FIGURE is a block circuit diagram of a preferred embodiment of the intruder detection apparatus.

DETAILED DESCRIPTION

An embodiment of the intruder detection apparatus of the invention comprises a microwave transmitter T and a corresponding receiver R which is spaced apart from the transmitter so that the space therebetween is that to be protected. The receiver is aligned with the transmitter, and serves basically to receive a signal therefrom and, upon occurrence of a change in level of this signal, to provide an alarm output.

In the illustrated case, an incoming signal is picked up by an aerial 10 from which it is fed to a detector diode 11, the output from which consists of the microwave fence modulation, typically 1 $KH_z$. In the event of the apparatus being installed near radar, this output is a modulated signal comprising the detected signal, plus narrow pulses from the interfering radar. The combined signals are supplied to a high-frequency selective amplifier 12 which passes the narrow pulses from the radar, but substantially rejects the low-frequency 1 $KH_z$ modulation.

Each pulse output from amplifier 12 is used to trigger a monostable 13 which produces a corresponding respective pulse of some thirty-microseconds duration. Each pulse is used to open a switch 14 (which will normally be closed) for the duration of the pulse.

The detected signal is also fed to a wide band amplifier 15. The output from amplifier 15 is fed to a delay line 16 which delays the signal for a nominal five-hundred-nanoseconds and the delay line output is amplified by a wide-band amplifier 17 and applied to switch 14. As switch 14 is under the control of monostable 13, should an interfering pulse occur, switch 14 will open before the interfering pulse appears at the output of amplifier 17. As the duration of the switch opening is in excess of any anticipated interfering pulse, the pulse is effectively suppressed. Consequently, the signal across a capacitor 18 is substantially that of the microwave fence modulation with the interfering pulse removed.

The time constant of capacitor 18 and a resistor 19 is such that while switch 14 is open the voltage across capacitor 18 will change little and hence the required modulation waveform is preserved.

The wanted modulation signal is then subsequently filtered so as to remove the wide band noise introduced by wide band amplifiers 15 and 17 to improve the overall signal to noise ratio.

The signal is then passed, as indicated at 20, to further signal-processing circuitry which serves to generate an alarm output in the event of a change occurring in the signal indicative of an intrusion into the protected space.

We claim:

1. Intruder detection apparatus comprising: a transmitter emitting a modulated microwave signal, and a corresponding receiver spaced from and aligned with the transmitter for receiving and monitoring the signal from the transmitter and including alarm means for providing an alarm output upon detection of a change in the monitored signal indicative of an intrusion into the area between transmitter and receiver, said receiver also including eliminator means effective for eliminating any narrow interfering pulses which may be superimposed upon the microwave signal by adjacent radar apparatus and comprising:

a primary high frequency selective amplifier for receiving the detected signal and passing the narrow interfering pulses while substantially rejecting the lower frequency modulation, a monostable triggered by the output of the primary amplifier for generating a pulse of short duration, of the order of 30 microseconds, corresponding to each interfering pulse, a normally closed switch controlled by the monostable so as to open for the duration of each monostable pulse, a secondary wide band amplifier for additionally receiving the detected signal, a delay line for receiving and delaying the secondary amplifier output before the feeding thereof to the normally closed switch, the normally closed switch in the event of radar interference being opened under control of said monostable before each interfering pulse reaches it thereby preventing passage of interfering pulses, and a capacitor and resistor for feeding the low frequency modulation free of the interfering pulses to the alarm means so that the intrusion detection capability of the apparatus is maintained at all times.

* * * * *